US009752822B2

(12) United States Patent
Lee et al.

(10) Patent No.: US 9,752,822 B2
(45) Date of Patent: Sep. 5, 2017

(54) REFRIGERATOR WITH WINE STORAGE CHAMBER

(71) Applicant: LG ELECTRONICS INC., Seoul (KR)

(72) Inventors: Su-Won Lee, Gyeongsangnam-do (KR); Sung-Eun Kim, Gyeongsangnam-do (KR); Kyung-Eun Lee, Gyeongsangnam-do (KR)

(73) Assignee: LG ELECTRONICS INC., Seoul (KR)

( * ) Notice: Subject to any disclaimer, the term of this patent is extended or adjusted under 35 U.S.C. 154(b) by 245 days.

(21) Appl. No.: 14/633,384

(22) Filed: Feb. 27, 2015

(65) Prior Publication Data

US 2015/0168051 A1 Jun. 18, 2015

Related U.S. Application Data

(62) Division of application No. 13/265,560, filed as application No. PCT/KR2009/004968 on Sep. 3, 2009, now abandoned.

(30) Foreign Application Priority Data

May 12, 2009 (KR) ..... 10-2009-0041054

(51) Int. Cl.
*F25D 3/08* (2006.01)
*F25D 25/02* (2006.01)
(Continued)

(52) U.S. Cl.
CPC ..... *F25D 25/025* (2013.01); *F25D 11/02* (2013.01); *F25D 17/045* (2013.01);
(Continued)

(58) Field of Classification Search
CPC ..... F25D 25/025; F25D 11/02; F25D 17/045; F25D 2400/02; F25D 2400/361;
(Continued)

(56) References Cited

U.S. PATENT DOCUMENTS

| | | | | |
|---|---|---|---|---|
| 2,290,572 | A | 7/1942 | Rakov | |
| 6,283,566 | B1 * | 9/2001 | Doces | A47G 23/0208 211/71.01 |
| 7,377,397 | B2 | 5/2008 | Lee | |
| 7,712,852 | B2 | 5/2010 | Choi | |
| 2003/0167787 | A1 | 9/2003 | Ohashi | |
| 2004/0160151 | A1 | 8/2004 | Collins | |
| 2005/0236947 | A1 | 10/2005 | LeClear | |
| 2006/0080994 | A1 * | 4/2006 | Seiden | F25D 11/02 62/441 |

(Continued)

FOREIGN PATENT DOCUMENTS

| | | | |
|---|---|---|---|
| CN | 101231082 | A | 7/2008 |
| JP | 2000130925 | A | 5/2000 |

OTHER PUBLICATIONS

Chinese Office Action dated Sep. 16, 2014 for CN Application No. 200980158827.2, in English, 9 pages.

*Primary Examiner* — Melvin Jones
(74) *Attorney, Agent, or Firm* — Fish & Richardson P.C.

(57) ABSTRACT

A refrigerator includes a cabinet defining a wine storage chamber, a door for the wine storage chamber, a pantry in the wine storage chamber, a rail guide located at an inner surface of the cabinet, and a draw-out rail located at the pantry. The pantry includes a first supporter for a wine glass, a second supporter for a wine bottle, a space defined between the first and second supporters, a first outlet at a front of the space, and a second outlet at a lateral side of the space.

10 Claims, 6 Drawing Sheets

(51) Int. Cl.
*F25D 11/02* (2006.01)
*F25D 17/04* (2006.01)

(52) U.S. Cl.
CPC .. *F25D 2331/803* (2013.01); *F25D 2331/808* (2013.01); *F25D 2331/809* (2013.01); *F25D 2400/02* (2013.01); *F25D 2400/361* (2013.01); *F25D 2700/121* (2013.01)

(58) Field of Classification Search
CPC ..... F25D 2700/121; F25D 2331/803; F25D 2331/808; F25D 2331/809; A47L 15/505; A47G 23/0208
USPC ..... 62/125, 441, 457.4, 457.5, 457.8
See application file for complete search history.

(56) References Cited

U.S. PATENT DOCUMENTS

2006/0218958 A1* 10/2006 Rand ..... F25D 11/022 62/302
2007/0163291 A1* 7/2007 Kim ..... F25D 17/065 62/408
2007/0228909 A1 10/2007 Hwang
2008/0047295 A1* 2/2008 Kim ..... A47B 96/06 62/441
2008/0168794 A1 7/2008 Cho
2008/0203875 A1 8/2008 Lim
2008/0217270 A1 9/2008 Lee
2009/0167130 A1 7/2009 Chellappan
2009/0193836 A1 8/2009 Ertz

* cited by examiner

REFRIGERATOR WITH WINE STORAGE CHAMBER

CROSS REFERENCES RELATED APPLICATIONS

This application is a divisional of U.S. application Ser. No. 13/265,560, filed Oct. 21, 2011, now pending, which is a U.S. National Phase of International Patent Application No. PCT/KR2009/004968, filed Sep. 3, 2009, which claims priority under 35 U.S.C. 119 and 35 U.S.C. 365 to Korean Patent Application No. 10-2009-0041054, filed on May 12, 2009, all of which is hereby incorporated by reference in its entirety.

BACKGROUND OF THE INVENTION

1. Field of the Invention

The present invention relates to a refrigerator, and more particularly, to a refrigerator that facilitates keeping and drawing out a container for storing wine.

2. Description of the Related Art

In general, a refrigerator is provided with a plurality of storage chambers in which stored goods are received in order to keep foods in a refrigerated or frozen state and one side of each of the storage chambers is opened so as to store and draw out the foods. In addition, doors that selectively shield the storage chambers are provided in front of the storage chambers.

Meanwhile, the storage chambers may include a freezing chamber and a refrigerating chamber. In general, the freezing chamber may maintain a storage temperature of −18° C. to −20° C. and the refrigerating chamber may maintain a storage temperature of 2° C. to 5° C.

Stored goods such as meat and fishes that should be frozen are kept in the freezing chamber and stored goods such as vegetables that should be refrigerated are kept in the refrigerating chamber.

However, according to the refrigerator in the related art, since storage temperature environments appropriate for various stored goods are not satisfied, the storing condition of some stored goods are deteriorated. In particular, in the case where a stored good is sensitive to the storage temperature, such as wine is kept in the refrigerator, the taste and aroma of wine are deteriorated due to even a small difference in temperature.

Meanwhile, wine is sensitive to vibration. Therefore, when a wine bottle is shaken, aging of wine is promoted, thereby deteriorating the quality of wine.

According to the refrigerator in the related art, when the refrigerator is vibrated due to closing the door of the refrigerator in the state where the wine bottle is kept in the refrigerator, wine is shaken, thereby deteriorating the quality.

SUMMARY OF THE INVENTION

The present invention is contrived to solve the above-mentioned problems. It is a first object of the present invention to provide a refrigerator that is provided with a storage chamber for separately storing wine.

Further, it is a second object of the present invention to provide a refrigerator that can control a storage temperature depending on the kind of stored wine.

Further, it is a third object of the present invention to provide a refrigerator that can protect wine from vibration which may be generated while operating the refrigerator.

In order to achieve the above-mentioned objects, a refrigerator according to an embodiment of the present invention includes: a freezing chamber and a refrigerating chamber; a wine storage compartment that is formed between the freezing chamber and the refrigerating chamber and forms a storage chamber of a wine storage container; a wine door that selectively shields the storage chamber; a storage unit that is drawably provided in the wine storage compartment; and a holder that is formed in the wine storage compartment for holding the wine storage container and has a shape corresponding to the wine storage container.

Further, a refrigerator according to another embodiment of the present invention includes: at least one input unit into which a command is inputted depending on the kind of stored wine; a memory unit that memorizes a present temperature value corresponding to the command inputted by the input unit; a display unit that displays the command inputted by the input unit or the temperature value memorized in the memory unit; a temperature sensing unit that senses the temperature of a wine storage compartment; a cool air supplying unit that is formed in the wine storage compartment and selectively supplies cool air; and a control unit that allows the cool air supplying unit to be selectively opened by comparing the preset temperature value with the current temperature sensed by the temperature sensing unit.

DETAILED DESCRIPTION OF THE PREFERRED EMBODIMENTS

Hereinafter, detailed embodiments of the present invention will be described with reference to the accompanying drawings. However, the spirit of the present invention is not limited to the proposed embodiments but another embodiment may be easily proposed by those skilled in the art who understand the spirit of the present invention within the same spirit of the present invention.

Figure 1:
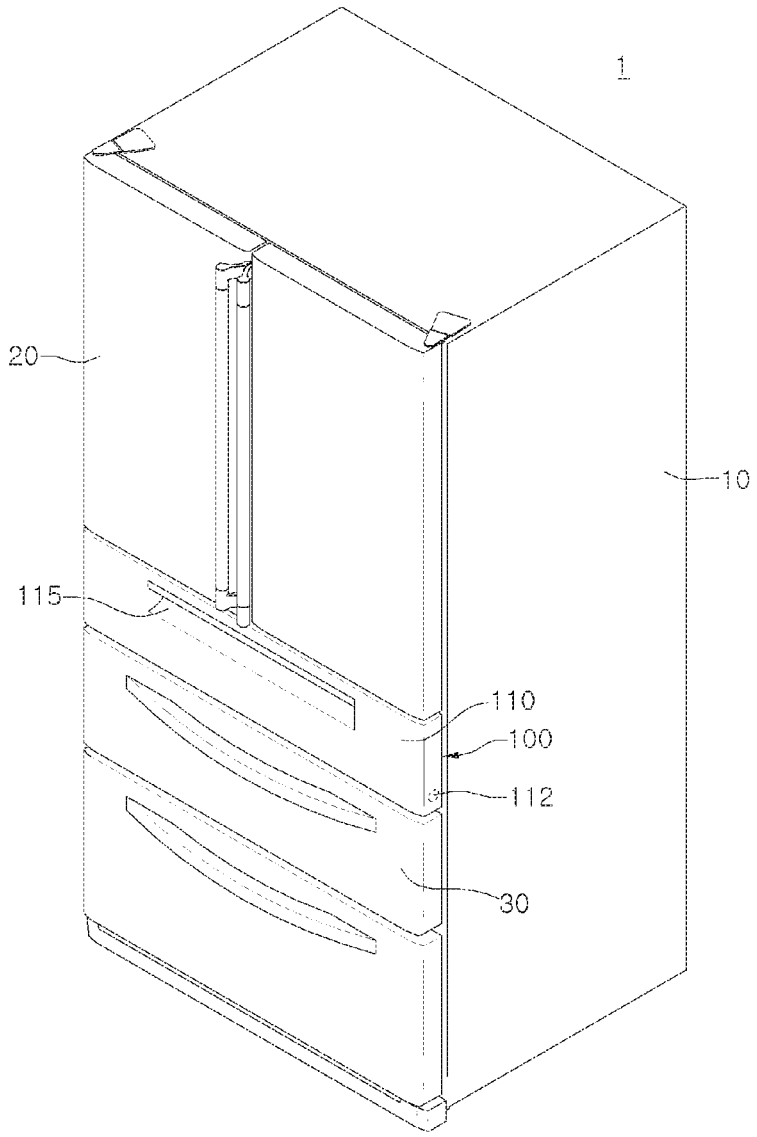
FIG. 1 is a perspective view showing an external appearance of a refrigerator according to a first embodiment of the present invention.
Figure 2:
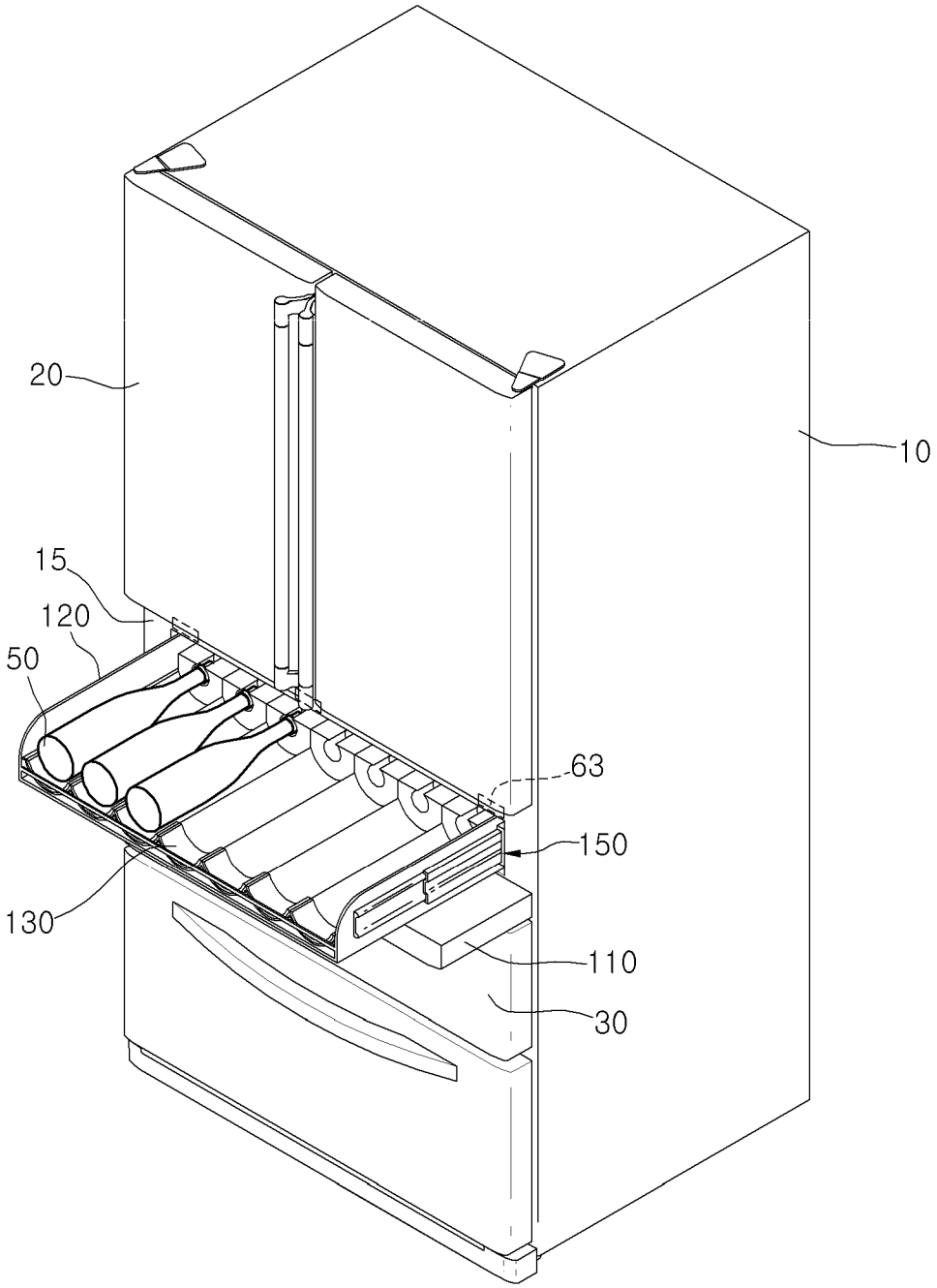
FIG. 2 is a perspective view of a refrigerator showing a state where a wine door is opened according to a first embodiment of the present invention.

FIG. 1 is a perspective view showing an external appearance of a refrigerator according to a first embodiment of the present invention and FIG. 2 is a perspective view of a refrigerator showing a state where a wine door is opened according to a first embodiment of the present invention.

Referring to FIGS. 1 and 2, the refrigerator 1 according to the embodiment of the present invention includes a main body 10 that forms a storage chamber and a refrigerator door that selectively shields the main body 10.

A refrigerating chamber for keeping the stores in a refrigeration state and a freezing chamber for keeping the stores in a freezing state are formed in the storage chamber. In addition, the refrigerator door includes a refrigerating chamber door 20 that selectively shields the refrigerating chamber and a freezing chamber door 30 that is installed below the refrigerating chamber door 20 and selectively shields the freezing chamber.

The refrigerating chamber door 20 may be rotatably joined to the front of the main body 10 and the freezing chamber door 30 may be drawably joined to the front of the main body 10. However, the joining formations of the doors 20 and 30 will not be limited to the embodiment of the present invention.

Further, although the refrigerating chamber is provided above the freezing chamber in the figures, the refrigerating chamber may be provided below the freezing chamber unlike this.

Meanwhile, a wine storage compartment 100 that forms a storage chamber for storing wine is provided in the main body 10. The wine storage compartment 100 is separately provided with being partitioned from the refrigerating chamber and the freezing chamber. For this, a partitioning part 15 that partitions the wine storage compartment 100 from the refrigerating chamber or the freezing chamber may be provided in the main body 10.

In addition, the wine storage compartment 100 may be formed between the refrigerating chamber and the freezing chamber.

Wine is stored in the wine storage compartment 100 and the wine storage chamber 100 includes a storage basket 120 provided to be drawable to the front and a wine door 110 rotatably joined to the front the storage basket 120. Herein, the storage basket 120 as a component for storing wine will be able to be referred to as "storage unit".

Further, the wine door 110 may be formed by a glass door so as to let an inner space of the storage basket 120 be seen from the outside.

A plurality of holders 130 to which a wine bottle 50 as a wine storage container is held are formed in the storage basket 120. The plurality of holders 130 may be partitioned with a shape in which each holder is recessed downwards. In addition, the plurality of wine bottles 50 may be held to the holder 130 to be arranged in line.

A hinge portion 112 rotatably joined to the lower end of the wine storage compartment 100 is provided in the wine door 110. The hinge portion 112 protrudes from both sides of the wine door 110 and may be inserted into the main body 10.

In addition, a door handle 115 operable by a user for opening the door 110 is formed on the front surface of the wine door 110. When the user pulls the door handle 115, the wine door 110 may rotate forward around the hinge portion 112.

Further, a magnetic member 63 that applies magnetic force to the wine door 110 in a state where the wine door 110 is closed is provided in the main body 10. A portion of the wine door 110 corresponding to the magnetic member 63 may be made of a steel material.

Meanwhile, a rail assembly 150 that guides drawing in and out of the storage basket 120 is provided in the wine storage compartment 110. The rail assembly 150 may be provided at least one surface of the storage basket 120 and the inner surface of the main body 10.

Hereinafter, a configuration of the rail assembly 150 will be described with reference to the figures.

Figure 3:
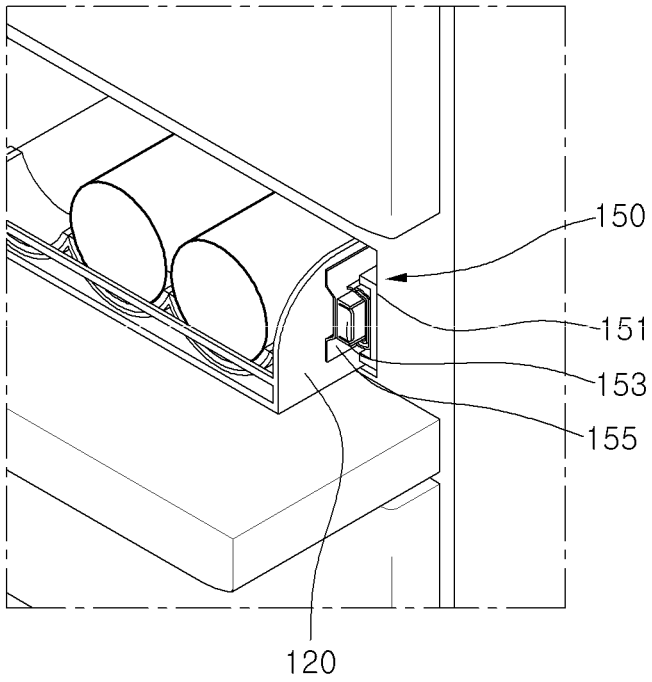
FIG. 3 is a perspective view showing a configuration of a rail assembly according to a first embodiment of the present invention.
Figure 4:
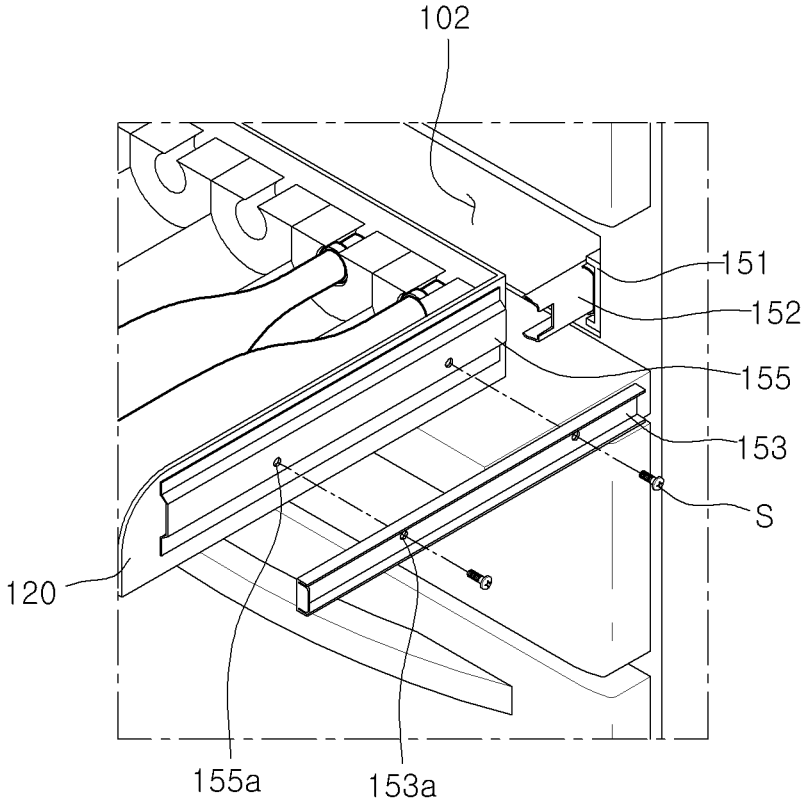
FIG. 4 is an exploded perspective view of a rail assembly according to a first embodiment of the present invention.

FIG. 3 is a perspective view showing a configuration a rail assembly according to a first embodiment of the present invention and FIG. 4 is an exploded perspective view of a rail assembly according to a first embodiment of the present invention.

Referring to FIGS. 3 and 4, the rail assembly 150 according to the first embodiment of the present invention includes a rail guide 151 that is provided on the inner surface of the main body 10 to guide movement of the storage basket 120, a draw-out rail 153 that is provided to be movable forward and rearward on the rail guide 151, and a fixation member 155 that joins the draw-out rail 153 to the storage basket 120.

More specifically, the rail guide 151 has a substantial "ㄷ" shape and may be joined to the inner surface of the main body 10. Herein, the rail guide 151 may be formed integrally with the main body 10.

In addition, an intermediate rail 152 that is provided to be movable forward and rearward with a shape corresponding to the rail guide 151 is provided inside of the rail guide 151. The intermediate rail 152 is disposed to be inserted into a concave groove of the rail guide 151.

The draw-out rail 153 is movably provided inside of the intermediate rail 152 and is disposed to be inserted into a concave groove of the intermediate rail 152. Further, a fastening hole 153*a* to which a screw S is fastened is formed in the draw-out rail 153. The screw S may be fixed to the storage basket 120 through the fastening hole 153*a*.

Further, the fixation member 155 for fixing the draw-out rail 153 is provided between the draw-out rail 153 and the storage basket 120. A joining hole 155*a* through which the screw S passes is formed in the fixation member 155. The screw S may be fixed to the storage basket 120 through the joining hole 155*a*.

An operation of the rail assembly 150 will be described below.

While the storage basket 120 is drawn out forward, the draw-out rail 153 is firstly drawn out together with the storage basket 120. In addition, when the draw-out rail 153 is completely drawn out, the intermediate rail 152 may be drawn out forward along the rail guide 151.

That is, the draw-out rail 153 and the intermediate rail 152 may be sequentially drawn out throughout two steps.

In contrast, while the storage basket 120 is drawn in to an internal storage chamber 102 of the wine storage compartment 100, the draw-out rail 153 may be firstly drawn in to the inside of the intermediate rail 152 and thereafter, the intermediate rail 152 may be drawn in to the inside of the rail guide 151.

Figure 5:
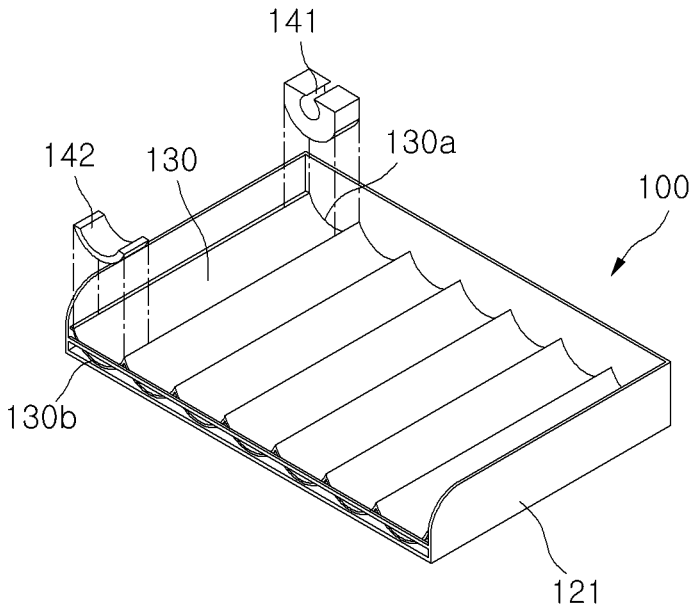
FIG. 5 is a diagram showing a configuration a wine storage compartment according to a first embodiment of the present invention.

FIG. 5 is a diagram showing a configuration a wine storage compartment according to a first embodiment of the present invention.

Referring to FIG. 5, the storage basket 120 according to the first embodiment of the present invention includes a basket body 121 that forms an external appearance and the holder 130 provided in the basket body 121 to which the wine bottle 50 is held.

More specifically, the holder 130 is formed to be recessed downward from the basket body 121. The recession size and shape correspond to the wine bottle 50. The holder 130 includes an upper holder 130*a* to which one side of the wine bottle 50 is held and a lower holder 130*b* to which the other side of the wine bottle 50 is held.

The upper portion of the wine bottle 50, that is, a neck portion of the bottle may be held to the upper holder 130*a* and the lower portion of the wine bottle 50 may be held to the lower holder 130*b*.

Vibration reducing members that reduce predetermined vibration in a state where the wine bottle 50 is placed are provided in the holders 130*a* and 130*b*. The vibration reducing members include a first vibration reducing member 141 provided in the upper holder 130*a* and a second vibration reducing member 142 provided in the lower holder 130*b*.

The first and second vibration reducing members 141 and 142 are interposed between the holder 130 and the wine bottle 50 to absorb shock transmitted from the holder 130 to the wine bottle 50.

The first vibration reducing member 141 may be a little thick to closely contact the neck portion of the wine bottle 50. That is, in a state where the wine bottle 50 is held to the holder 130, the neck portion of the wine bottle 50 may closely contact the holder 130 by the first vibration reducing member 141.

Meanwhile, the second vibration reducing member 142 may be formed to closely contact the lower portion of the wine bottle 50. In general, since the lower portion of the wine bottle has a radius larger than the neck portion, the second vibration reducing member 142 will be able to have a thickness thinner than the first vibration reducing member 141.

However, the sizes and shapes of the vibration reducing members 141 and 142 are not limited to any one. If the upper portion and the lower portion of the wine bottle 50 can closely contact the holder 130 with ease, various embodiments may be proposed.

The vibration reducing members 141 and 142 may be made of a rubber or sponge material so as to absorb predetermined vibration and may be attached to the holder 130.

Meanwhile, in the embodiment, although the vibration reducing members are provided in the upper portion and the lower portion of the holder 130, the vibration reducing members may be provided at another position or throughout the entire surface of the holder 130.

Further, the vibration reducing member may be interposed between the basket 120 and the holder 130. In this case, while the basket 120 is drawn in and out, vibration generated between the basket 120 and the holder 130 will be able to be absorbed in the vibration reducing members.

Figure 6:
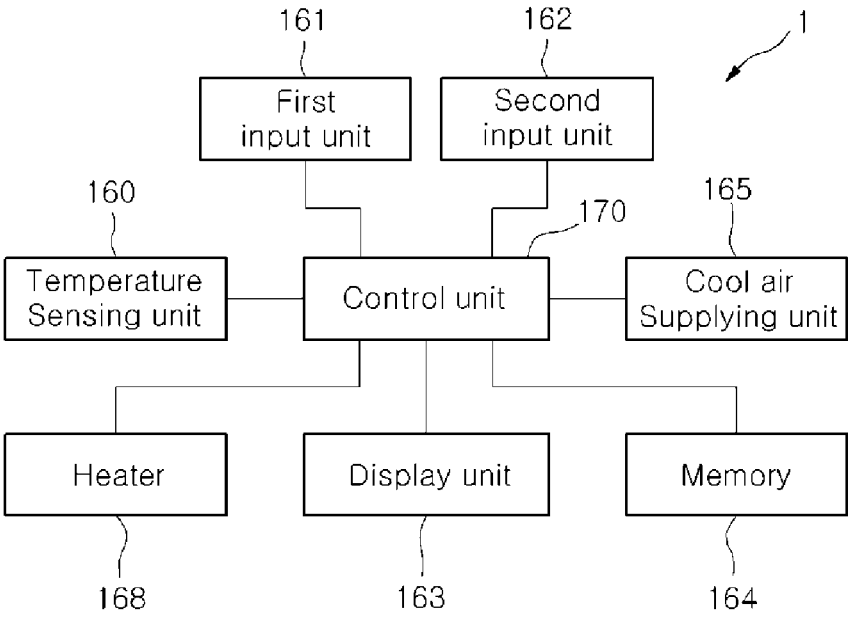
FIG. 6 is a block diagram showing a configuration of a refrigerator according to a first embodiment of the present invention.

FIG. 6 is a block diagram showing a configuration of a refrigerator according to a first embodiment of the present invention.

Referring to FIG. 6, the refrigerator 1 according to the first embodiment of the present invention includes a first input unit 161 and a second input unit 162 that can be selectively operated depending on the kind of stored wine, a memory 164 that memorizes a preset temperature value by inputting a command in the input units 161 and 162, a display unit 163 that displays the command inputted by the input units 161 and 162, a temperature sensing unit 160 that senses the temperature of the storage chamber 102 of the wine storage compartment 100, a cool air supplying unit 165 that is provided in the storage chamber 102 and selectively supplies cool air depending on a value sensed by the temperature sensing unit 160, and a control unit 170 that controls operations of the components 160, 161, 162, 163, and 165.

More specifically, the input units 161 and 162 can be selectively operated depending on the kind of wine. For example, when the stored wine is white wine, the first input unit 161 can be selected and when the stored wine is red wine, the second input unit 162 can be selected.

In general, the white wine is preferably stored in the range of approximately 10° C. to 15° C. and the red wine is preferably stored in the range of approximately 15° C. to 20° C.

Therefore, when the white wine is selected through the first input unit 161, the temperature of the storage chamber 102 can be controlled to be maintained at any one value in the range of 10° C. to 15° C., i.e., approximately 12° C. In contrast, when the red wine is selected through the second input unit 162, the temperature of the storage chamber 102 can be controlled to be maintained at any one value in the range of 15 to 20° C., i.e., approximately 18° C.

Of course, the temperature value (12° C., 18° C., or others) that should be maintained depending on the kind of wine may be previously set and the set temperature value may be memorized in the memory 164.

Although not shown in the figure, the refrigerator may further include another input unit that allows the user to directly input the set temperature of the storage chamber 102 except for the input units 161 and 162.

When a predetermined command is inputted by the input units 161 and 162, the kind of stored wine may be displayed on the display unit 163 on the basis of the inputted command. In addition, the temperature value stored in the memory 164 may be displayed on the display unit 163 depending on the kind of wine.

The temperature sensing unit 160 senses the internal temperature of the storage chamber 102 and transfers the result to the control unit 170. The control unit 170 can compare a current temperature value sensed by the temperature sensing unit 160 with a predetermined set temperature in accordance with the command inputted by the input units 161 and 162.

If the set temperature value is lower than the current temperature value, the control unit 170 opens the cool air supplying unit 165 to supply the cool air to the storage chamber 102.

In contrast, if the set temperature value is higher than the current temperature value, the control unit 170 closes the cool air supplying unit 165 to stop supplying the cool air.

Further, a heater 168 for increasing the internal temperature of the storage chamber 102 can be provided in the storage chamber 102. When the set temperature value is higher than the current temperature value, the heater 168 is activated to transfer predetermined heat to the storage chamber 102, such that the temperature of the storage chamber 102 can be increased to the set temperature.

As described above, since the temperature of the storage chamber 102 of the wine storage compartment 100 can be controlled independently from the refrigerating chamber and the freezing chamber, wine can be stored under the optimal temperature condition.

Hereinafter, a second embodiment of the present invention will be described. Since the second embodiment has the difference in the configuration of the wine storage compartment as compared to the first embodiment, the difference will mainly be described and the same elements as the first embodiment refer to the same descriptions and reference numerals of the first embodiment.

Figure 7:
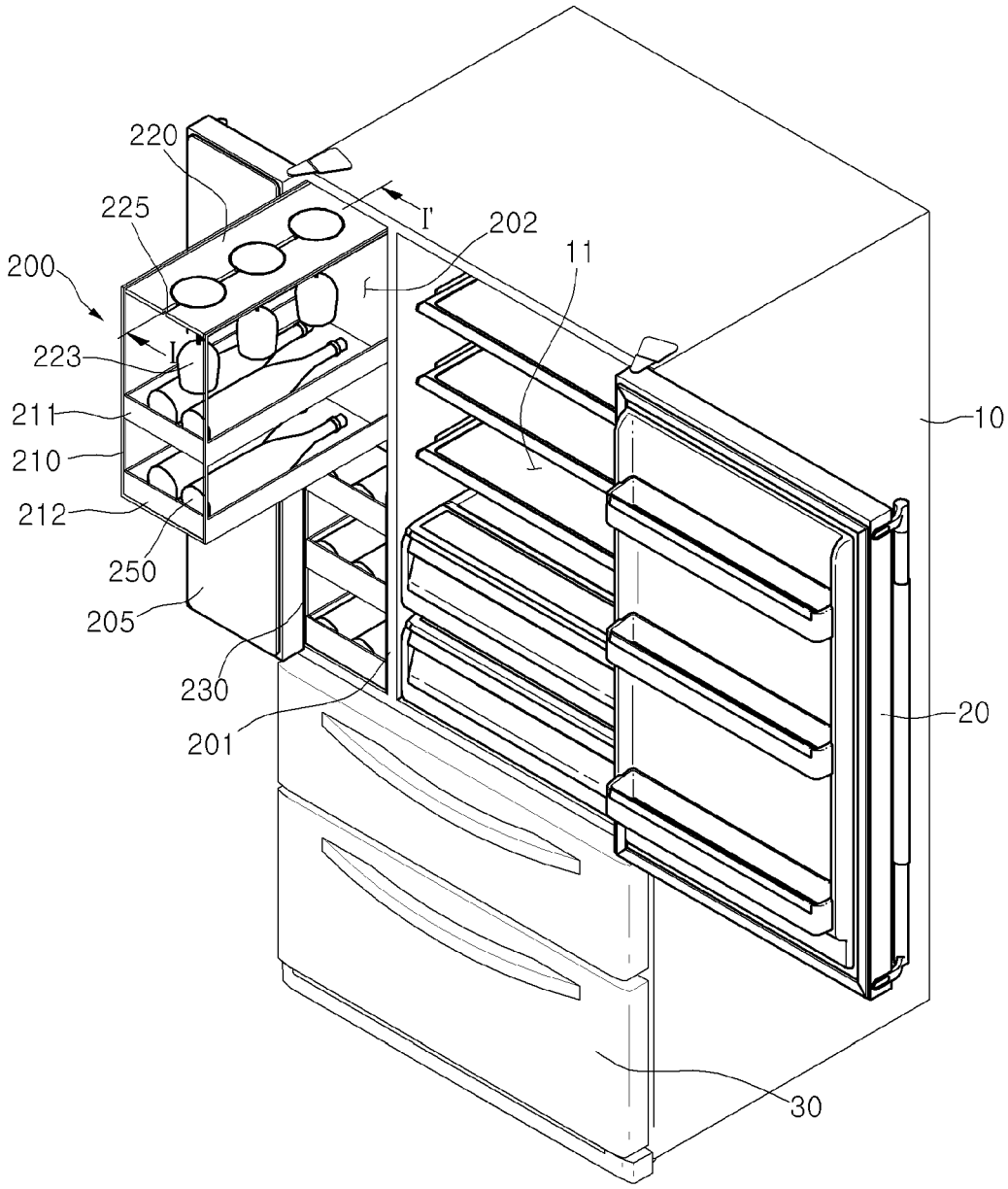
FIG. 7 is a perspective view showing a configuration of a refrigerator according to a second embodiment of the present invention.
Figure 8:
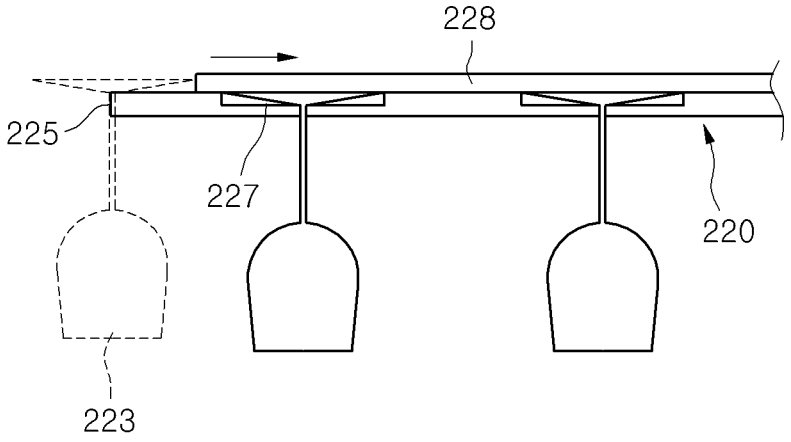
FIG. 8 is a cross-sectional view taken along line I-I' of FIG. 7.
Figure 9:
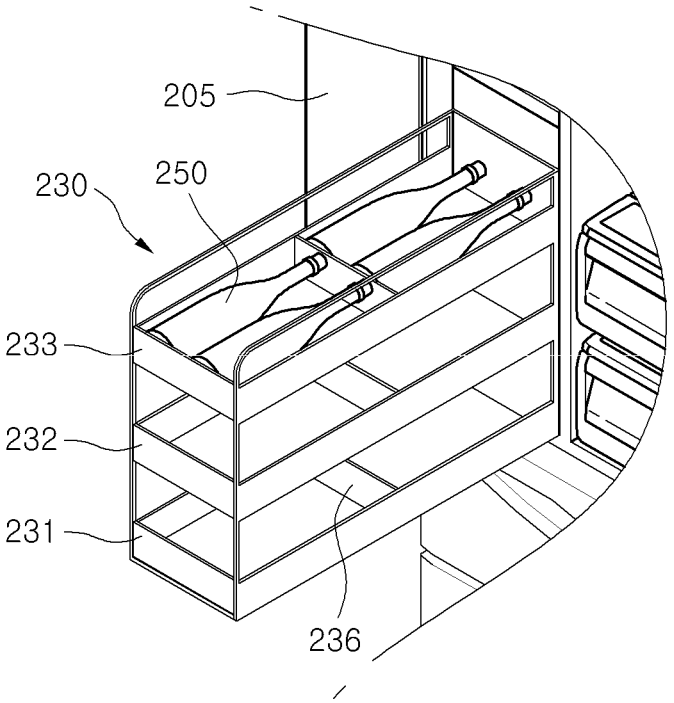
FIG. 9 is a perspective view showing a state where a second storage unit is drawn out according to a second embodiment of the present invention.

FIG. 7 is a perspective view showing a configuration of a refrigerator according to a second embodiment of the present invention, FIG. 8 is a cross-sectional view taken along line I-I' of FIG. 7, and FIG. 9 is a perspective view showing a state in which a second storage unit is drawn out according to a second embodiment of the present invention.

Referring to FIGS. 7 to 9, the main body 10 according to the second embodiment of the present invention includes a wine bottle 250 that stores wine and a wine storage compartment 200 in which a wine glass 223 provided to put and drink wine is kept.

The wine storage compartment 200 may be disposed at one side of a refrigerating chamber 11 separately from the refrigerating chamber 11. The wine storage compartment 200 and the refrigerating chamber 11 may be partitioned from each other by a partitioning part 201.

A plurality of storage units that keep the wine bottle 250, the wine glass 223 and a wine door 205 that selectively shields a storage space 202 are provided in the wine storage compartment 200.

More specifically, the plurality of storage units include a first storage unit 210 in which the wine bottle 250 and the wine glass 223 are held and drawably provided and a second storage unit 230 that is drawably provided at one side of the first storage unit 210 and the wine bottle 250 is held.

A plurality of storages in which the wine bottle is kept are provided in the first storage unit 210. The plurality of storages include an upper storage 211 and a lower storage 212 that is disposed spaced from the upper storage 211 by a predetermined distance downward.

However, although not shown in the figure, the plurality of storages may be configured to be disposed in a horizontal direction.

A configuration in which the wine bottle 250 is held to the upper and lower storages 211 and 212 refers to the configuration of the storage basket 120 described in the first embodiment. Hereinafter, a detailed description thereof will be omitted.

Further, a hanger unit 220 holding the wine glass 223 is provided at one side of each of the upper and lower storages 211 and 212. The hanger unit 220 can be drawn out together with the upper and lower storages 211 and 212.

The hanger unit 220 includes an insertion unit 225 that is formed on the front surface of the hanger unit 220 and is inserted with the wine glass 223, a support surface 227 that supports the wine glass 223, and a guide unit 228 that guides movement to the support surface 227 in the state where the wine glass 223 is inserted into the insertion unit 225.

The insertion unit 225 is opened on the front surface of the hanger unit 220 and extends toward the rear side of the hanger unit 220. The guide unit 228 is formed at both sides of the top of the hanger unit 220 and may extend toward the rear side.

Further, the support surface 227 is recessed downward from the top of the hanger unit 220 and may be formed in plural. The plurality of support surfaces 227 may be arranged spaced from each other in the front and rear direction.

The wine glass 223 may move rearward in the state where the wine glass 223 is supported on the top of the hanger unit 220. At this time, both sides of the wine glass 223 may be guided by the guide unit 228. In addition, when the wine glass 223 reaches the support surface 227, the wine glass 223 may be held on the support surface 227 while slightly moving downward.

As described above, since the wine glass 23 can be maintained at the same temperature as the temperature of wine, it is possible to prevent the temperature of wine from being changed in spite of pouring wine into the wine glass 223.

Meanwhile, a configuration of a rail assembly that allows the first storage unit 210 to be drawn out refers to the configuration of the rail assembly 150 described in the first embodiment. Hereinafter, a detailed description will be omitted.

Meanwhile, the second storage unit 230 includes a plurality of storages 231, 232, and 233 in which the wine bottle 250 is kept. The storages 231,232,233 may be arranged spaced from each other in the upper and lower direction.

A partitioning plate 236 that partitions a plurality of stored wine bottles 250 is provided in each of the storages 231, 232, and 233. The partitioning plate 236 can prevent the plurality of wine bottles 250 from colliding with each other. In particular, the partitioning plate 236 can prevent collisions caused due to vibration generated while the second storage unit 230 is drawn in and out.

Meanwhile, a configuration in which the wine bottle 250 is held to the storages 231, 232, and 233 refers to the configuration of the storage basket 120 described in the first embodiment. Hereinafter, a detailed description thereof will be omitted.

In the embodiment, although the first storage unit 210 and the second storage unit 230 are separately drawn out, the storage units 210 and 230 may be integrally formed and drawn out at the same time.

In addition, although the wine bottle and the wine glass are drawn out at the same time as the first storage unit 210 is drawn in and out, another storage unit to which the wine glass 223 is separately held may be provided. That is, various embodiments of arrangement of the wine bottle 250 and the wine glass 223 can be implemented.

By the above-mentioned configuration, wine can be stored at proper temperature and can be safely stored against vibration caused by drawing in and out the storage basket or the storage unit.

According to an embodiment of the present invention, since a refrigerator is provided with a wine storage compartment keeping wine separately from a freezing chamber and a refrigerating chamber, the refrigerator has an advantage of independently controlling temperature in accordance with the characteristic of wine. In addition, the refrigerator can appropriately control the temperature in accordance with the kind of wine.

Further, since an anti-vibration member is provided in the wine storage compartment, it is possible to protect wine from vibration of the refrigerator.

In addition, since a wine glass is kept in the refrigerator to be controlled at appropriate temperature, it is possible to prevent the quality of wine from being deteriorated due to the temperature of the wine glass.

Consequently, since a user who habitually uses wine can keep and drink wine under optimal conditions, the reliability to the product can be improved.

According to an embodiment of the present invention, since a refrigerator is provided with a wine storage compartment keeping wine separately from a freezing chamber and a refrigerating chamber, the refrigerator has an advantage of independently controlling temperature in accordance with the characteristic of wine.

What is claimed is:

1. A refrigerator, comprising:

a cabinet having a wine storage chamber;

a door that selectively closes the wine storage chamber;

a pantry provided in the wine storage chamber, the pantry comprising:

a first supporter provided at an upper portion of the pantry to support a wine glass, and a second supporter provided at a lower portion of the pantry to support a wine bottle;

a rail guide provided on both sides of an inner surface of the cabinet; and a draw-out rail installed at the pantry to be movable forward and rearward on the rail guide, wherein the pantry defines: (i) a space between the first supporter and the second supporter, the space being configured to accommodate at least a portion of the wine glass, (ii) a first outlet located at a front portion of the space and configured to pass the wine bottle therethrough, and (iii) a second outlet located at a lateral portion of the space and configured to pass the wine bottle therethrough, wherein the first supporter and the second supporter are configured, based on the door being open, to be withdrawn from the wine storage chamber, and wherein the first outlet and the second outlet are configured, based on the second supporter being withdrawn from the wine storage chamber, to be exposed to an outside of the refrigerator to thereby allow a user to take the wine bottle in and out of the second supporter through the first outlet and the second outlet.

2. The refrigerator according to claim 1, wherein the first supporter comprises:

an opening into which the wine glass is inserted; and a guide portion extended from the opening to guide movement of the wine glass.

3. The refrigerator according to claim 2, wherein the opening is formed at an end of the first supporter.

4. The refrigerator according to claim 1, wherein the first supporter comprises a support surface recessed downward from a top portion of the pantry to support at least a portion of the wine glass.

5. The refrigerator according to claim 4, wherein the first supporter further comprises a plurality of support surfaces arranged in a line.

6. The refrigerator according to claim 1, wherein the wine bottle is received on a surface of the second supporter.

7. The refrigerator according to claim 1, wherein the second supporter comprises a plurality of second supporters arranged in a longitudinal direction.

8. The refrigerator according to claim 1, further comprising:

at least one input unit into which a command is inputted depending on a kind of wine stored in the wine storage chamber;

a memory unit that memorizes a present temperature value corresponding to the command inputted by the input unit; and a display unit that displays the command inputted by the input unit or the present temperature value memorized in the memory unit.

9. The refrigerator according to claim 1, further comprising:

a temperature sensing unit that senses a temperature of the wine storage chamber;

a cool air supplying unit that is formed in the wine storage chamber and selectively supplies cool air; and a control unit that allows the cool air supplying unit to be selectively opened by comparing a preset temperature value with a current temperature sensed by the temperature sensing unit.

10. The refrigerator according to claim 9, further comprising:

a heater that supplies heat to the wine storage chamber based on the preset temperature being higher than the current temperature of the wine storage chamber.

* * * * *